United States Patent [19]

Watabe

[11] 4,343,695

[45] Aug. 10, 1982

[54] SYSTEM FOR NON-MAGNETIC METAL SELECTION

[75] Inventor: Yasuo Watabe, Kawasaki, Japan

[73] Assignee: Fuji Electric Co., Ltd., Kanagawa, Japan

[21] Appl. No.: 204,977

[22] Filed: Nov. 7, 1980

Related U.S. Application Data

[63] Continuation of Ser. No. 964,018, Nov. 27, 1978, abandoned.

[30] Foreign Application Priority Data

Nov. 28, 1977 [JP] Japan ..... 52-142379

[51] Int. Cl.[3] ..... B03C 1/10

[52] U.S. Cl. ..... 209/212; 209/227

[58] Field of Search ..... 209/212, 215, 219, 225, 209/227

[56] References Cited

U.S. PATENT DOCUMENTS

| | | | |
|---|---|---|---|
| 2,074,085 | 3/1937 | Frantz | 209/222 X |
| 2,282,510 | 5/1942 | Begar | 209/222 |
| 2,287,804 | 6/1942 | Johnson | 209/225 X |
| 2,913,113 | 11/1959 | Gillette | 209/225 X |
| 2,964,184 | 12/1960 | Gillette | 209/214 X |
| 3,021,007 | 2/1962 | Jones | 209/228 X |
| 3,830,367 | 8/1974 | Stone | 209/222 X |
| 4,046,679 | 9/1977 | Schloemann | 209/212 |
| 4,046,680 | 9/1977 | Fritz | 209/225 X |
| 4,070,278 | 1/1978 | Hunter | 209/212 |
| 4,172,030 | 10/1979 | Yasumachi | 209/212 |

FOREIGN PATENT DOCUMENTS

| | | | |
|---|---|---|---|
| 253728 | 12/1911 | Fed. Rep. of Germany | 209/228 |
| 22523 | of 1908 | United Kingdom | 209/221 |

*Primary Examiner*—Ralph J. Hill

*Attorney, Agent, or Firm*—Sughrue, Mion, Zinn, Macpeak & Seas

[57] ABSTRACT

A system for separation of non-magnetic metal particles in a mixture using an inclined rotating drum and the action of a travelling electromagnetic field. The mixture is introduced at the upper end of the inclined drum which is externally driven about its outer circumference in one direction. Simultaneously, a shifting electromagnetic field is generated along the lower part of the outer periphery of the drum in an opposite direction to rotation of the drum. The mixture as it travels through the drum is repeatedly moved upward in the direction of drum rotation along the inner wall due to frictional forces or in the direction of the shifting electromagnetic field. The successive raising and tumbling to the bottom of the drum provides complete stirring and promotes separation irrespective of particle size. The force of the electromagnetic field is not reduced by coverage with non-magnetic particles and a clear path exists since the interior of the drum is free of any obstructions.

7 Claims, 7 Drawing Figures

SYSTEM FOR NON-MAGNETIC METAL SELECTION

This is a continuation of application Ser. No. 946,018, filed Nov. 27, 1978 (now abandoned).

BACKGROUND OF THE INVENTION

The invention relates to a non-magnetic metal sorting system using a shifting magnetic field to select non-magnetic metals from a mixture including them.

The use of a shifting electromagnetic field is known to separate and select non-magnetic metals from a mixture having its iron component removed by means of magnets for the purpose of resource recovery from solid waste. For this purpose, there have been proposed in the art several apparatuses schematically shown in FIGS. 1 through 5. One example shown in FIG. 1 employs a shifting electromagnetic field generator to produce an electromagnetic force acting in the direction indicated by the arrow a on the mixture including non-magnetic metal particles. The mixture supplied from a chute 1 and transported by means of a belt conveyer 2 so that the non-magnetic metal particles are moved in the direction indicated by the arrow b and the remainder of the mixture is moved in the direction indicated by the arrow c.

The apparatus shown in FIG. 2 includes a shifting electromagnetic field generator 3 to produce an electromagnetic force in the direction indicated by the arrow a so that the non-magnetic metal particles are accelerated in the same direction as the direction of travel of the belt conveyer 2 and discharged in a position removed from the belt conveyer 2 as indicated by the arrow b while the remainder of the mixture is discharged in a position near the belt conveyer 2 as indicated by the arrow c.

In the FIG. 3 apparatus, a shifting electromagnetic field generator 3 is used to produce an electromagnetic force exerted in a direction opposite to the direction of travel of the belt conveyer 2. The non-magnetic metal particles are discharged as shown by the arrow b and the remainder of the mixture is discharged as shown by the arrow c.

Such conventional non-magnetic metal separating apparatus generally provide a satisfactory separation of non-magnetic metal particles from the mixture, but where the non-magnetic metal particles are a different size from the remainder of the mixture, the conventional apparatus do not perform well. Where the size of the non-magnetic metal particles is relatively smaller than that of the remainder, the non-magnetic metal particles will be held between the larger particles of the remainder and cannot be effectively separated therefrom by the electromagnetic force acting on the non-magnetic metal particles. On the contrary, where the size of the non-magnetic metal particles is relatively larger than that of the remainder, the non-magnetic metal particles will trap the smaller particles of the remainder.

In order to obviate the above-mentioned drawbacks the applicant has provided an apparatus capable of selecting non-magnetic metals from a mixture regardless of the relative size of the non-magnetic metal particles. This device is disclosed in Applicant's pending U.S. patent application Ser. No. 843,914 filed on Oct. 20, 1977, and entitled "NON-MAGNETIC METAL SELECTING METHOD AND APPARATUS." This prior art system operates by introducing a mixture including non-magnetic metals through a chute into a rotary drum inclined at an angle with an arch-shaped shifting electromagnetic file generator covering the bottom outer surface of the drum to produce a shifting magnetic field in a direction opposite to the direction of rotation of the drum. As a result, the non-magnetic metals and the remainder of the mixture are fully stirred during the transportation of the mixture through the rotary drum thereby facilitating the selection of the non-magnetic metals from the mixture and providing an accurate selection of non-magnetic metals from the mixture.

This conventional apparatus is shown in FIGS. 4 and 5 wherein FIG. 5 is a sectional view of the conventional metal sorting apparatus taken along the line A—A of FIG. 4. In FIG. 4, the mixture including non-magnetic metal particles transported on a belt conveyer 4 is supplied through a chute 1 into a rotary drum 5 made of an electrically insulative material. The drum 5 is supported through support rods 6 by an iron core 7 through which a rotary shaft 8 extends so that the drum 5 is rotated in the clockwise direction indicated by the arrow e in FIG. 5 as the rotary shaft 8 is rotated by drive means 9. The support rods 6 are preferably made in a cylindrical form and as slender as possible to permit the free movement of the mixture including non-magnetic metal particles. As arch-shaped shifting field generator 10 is disposed just under the lower side of the rotary drum 5 to cover $\frac{1}{3}$ to $\frac{1}{2}$ of the outer peripheral surface of the drum 5 to produce a shifting electromagnetic field in the counterclockwise direction indicated by the arrow a in FIG. 5 opposite to the direction of rotation of the drum 5. The rotary drum 5 is inclined at an angle determined such that the mixture including non-magnetic metal particles does not pass by its weight through the rotary drum 5 in a short time. The mixture travels therethrough and is brought upwardly in the direction of arrow e along the inner surface of the drum 5 due to the frictional force between the mixture and the drum inner surface or upwardly in the direction of arrow a along the inner surface of the drum 5 due to the electromagnetic force produced by the shifting field generator. It then falls by its weight thereby providing a complete stirring of the mixture within the drum so as to separate the non-magnetic metal particles from the mixture.

That is, the mixture other than the non-magnetic metal particles is lifted along the inner surface of the drum 5 while the frictional force between the mixture and the drum inner surface overcomes the weight thereof and then tumbles down onto the bottom of the rotary drum 5 and again is lifted up along the drum inner surface due to the frictional force. This is repeated so that the mixture other than the non-magnetic particles reaches the downstream end of the rotary drum 5 through the path indicated by the broken arrow d in FIG. 4. On the other hand, the non-magnetic metal particles are subjected to the electromagnetic force produced by the shifting magnetic field generator 10 to move in the direction opposite to the direction of rotation of the cylindrical drum 5 because the electromagnetic force overcomes the frictional force between the non-magnetic metal particles and the drum inner surface.

Since the shifting magnetic field generator 10 is disposed to cover the lower part of the drum 5 as shown in FIG. 5, the part of the non-magnetic metal particles sent beyond the range in which the shifting electromagnetic field exists is returned to the range of the electromagnetic field due to the weight thereof, and the non-magnetic metal particles are again subject to the action of the electromagnetic force. This is repeated until the non-magnetic metal particles reach the downstream end the rotary drum 5. Accordingly, because the shifting magnetic field is directed as indicated by the arrow a and the rotary drum 5 is rotated in the direction as indicated by the arrow e in FIG. 5, the non-magnetic metal particles are separated to the right as indicated by the block particles and the remainder of the mixture is separated to the left as indicated by white particles at the downstream end of the drum 5.

At the downstream end of the rotary drum 5, the non-magnetic metal particles and the remainder of the mixture can separately fall down. The separation plate 11 in contact with the drum inner surface at the boundary between the non-magnetic metal particles and the remainder of the mixture is effective to adequately separate them.

In the conventional device shown in FIGS. 4 and 5, the iron core 7 would be effective in order to increase the exciting-magnetic force of the shifting magnetic field generator 10. However, in the case where a large mass of solid waste are supplied into the rotary drum 5, the iron core 7 and the support rods 6 may prevent these wastes including non-magnetic metal from smoothly passing through the drum 5. Further, sorting efficiency would deteriorate since the non-magnetic metal moved in the direction opposite to the direction of the rotation of the cylindrical drum 5 would be forcibly moved to the rotating direction of the drum 5 by the support rods.

Furthermore, non-magnetic metals moved in the direction opposite to the direction of the rotation of the drum 5 by the shifting magnetic field generator 10 may immediately tumble down on the drum surface due to gravity and frictional forces caused by drum rotation. Upon passing over the generator 10 its electro-magnetic force would be severly decreased so that the non-magnetic metal may move in the direction of rotation of the drum 5, to thereby degrade sorting efficiency. The sorting operation would also be interrupted since relatively large materials would be pinched by the drum 5 and the separation plate 11.

SUMMARY OF THE INVENTION

It is therefore an object of this invention to overcome the above-mentioned drawbacks and to provide an improved system capable of selecting non-magnetic metals from a mixture.

It is another object of this invention to provide a system capable of selecting non-magnetic metals from a mixture irrespective of the size or shape of the non-magnetic meterials.

These and other objects of this invention are attained by a non-magnetic metal sorting system using an external drive mechanism for effectuating rotation of the drum. As the mixture travels through the drum it is unimpeded during the mixing process. The mixture is repeatedly moved upward in the direction of drum rotation or upwardly due to the electromagnetic force produced by a travelling field generator. Complete stirring and separation occur irrespective of the relative size of the particles.

DESCRIPTION OF THE PREFERRED EMBODIMENTS

One embodiment of a non-magnetic metal selecting apparatus in accordance with the present invention will be described, by way of example, with reference to FIGS. 6 and 7.

Figure 1:
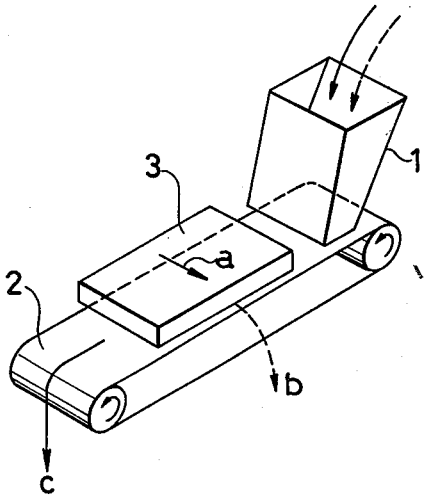
FIG. 1 PRIOR ART
FIGS. 1 to 3 are perspective views showing conventional non-magnetic selecting apparatuses.
Figure 2:
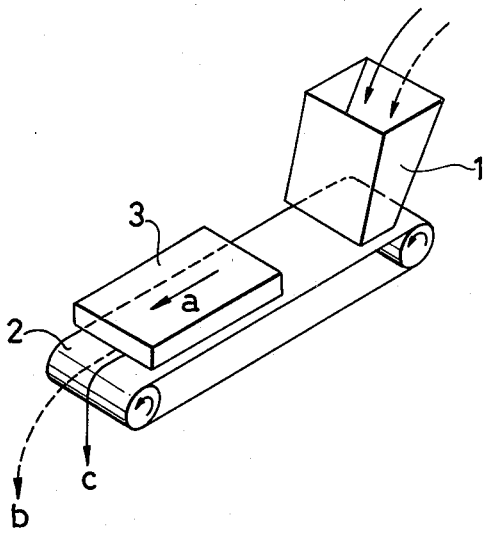
FIG. 2 PRIOR ART
Figure 3:
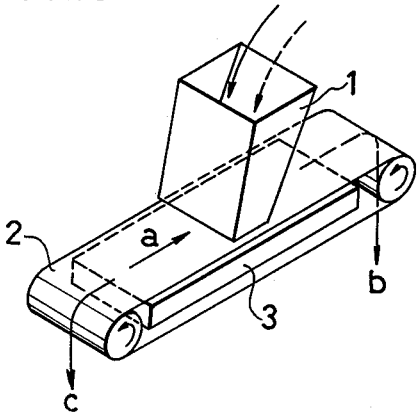
FIG. 3 PRIOR ART
Figure 4:
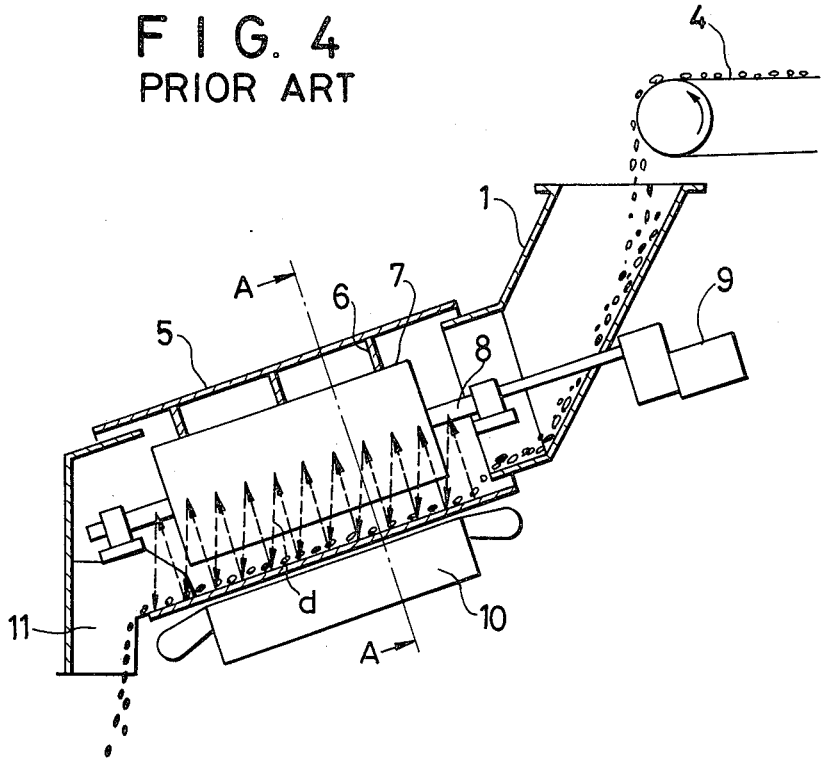
FIG. 4 PRIOR ART
FIG. 4 is a cross-sectional view showing a non-magnetic metal selecting apparatus according to a prior art application.
Figure 5:
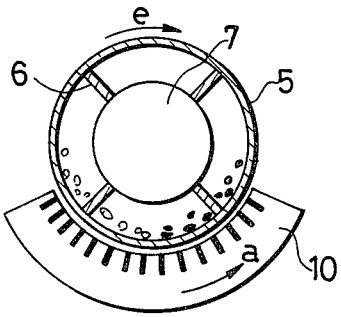
FIG. 5 is a sectional view taken along the line V—V of FIG. 4.
Figure 6:
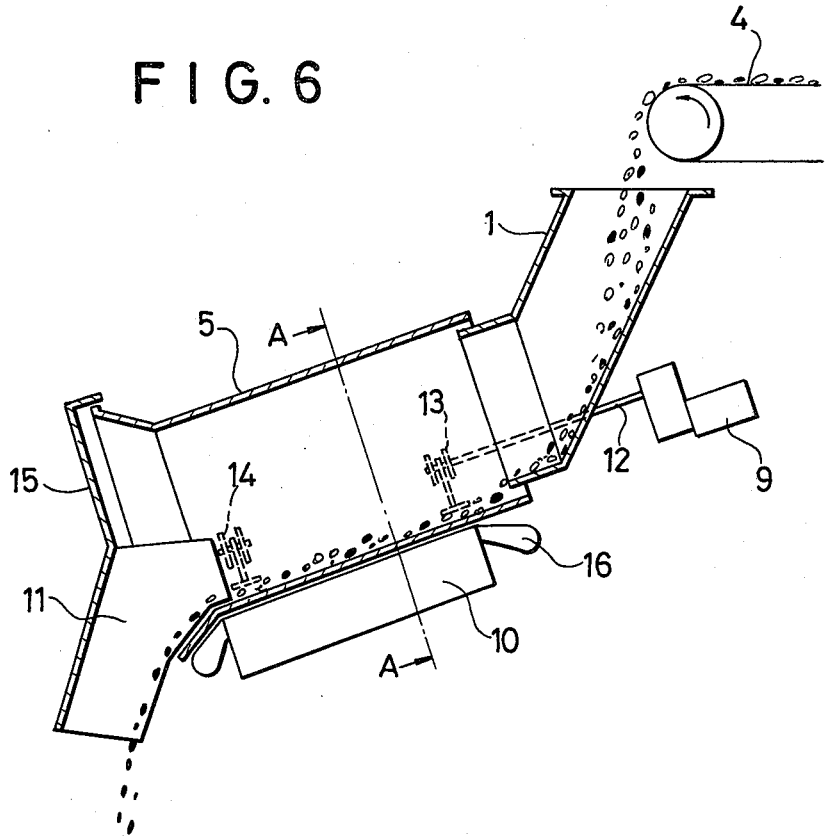
FIG. 6 is a sectional view showing the preferred embodiment of a non-magnetic metal selecting apparatus according to the present invention.
Figure 7:
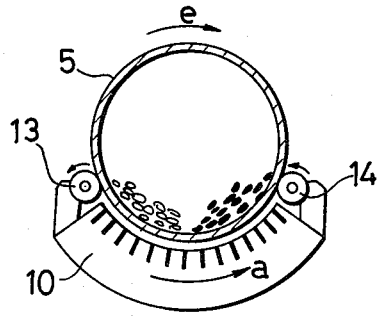
FIG. 7 is a sectional view taken along the line VII—VII of FIG. 6.

FIG. 6 shows one embodiment of such a non-magnetic metal selecting apparatus in accordance with the present invention and FIG. 7 is a sectional view of the FIG. 6 embodiment taken along the line VI—VI. In FIG. 6, the mixture including non-magnetic metal particles transported on a belt conveyer 4 is supplied through a chute 1 into a rotary drum 5. The drum need not be electrically insulative. The drum 5 is supported by rollers 13 and 14. The roller 13 can be rotated through a shaft 12 by drive means 9. The drive means may be a motor either directly driving the roller or employing a gear reduction mechanism. The rollers 13 and 14 have preferably an outer surface which is covered with elastic material to cushioningly transmit the rotation movement of the rollers to the drum by friction force therebetween. This invention, then, departs in one aspect from the prior art since the drum is externally driven and the iron core is eliminated.

An arch-shaped travelling field generator 10 is disposed just under the lower side of the rotary drum 5 to cover $\frac{1}{3}$ to $\frac{1}{2}$ of the outer peripheral surface of the drum 5 for producing a travelling electromagnetic field in the counterclockwise direction indicated by the arrow a in FIG. 7 opposite to the direction of rotation of the drum 5. A separation plate 11 is provided at the downstream horn-like end of the rotary drum 5. The rotary drum 5 is inclined at an angle such that the mixture including non-magnetic metal particles will not pass through the rotary drum 5 by its weight alone in a short period of time. Rather, it travels therethrough with the mixture brought upwardly in the direction of arrow e along the inner surface of the drum 5 to the frictional force between the mixture and the drum inner surface or upwardly in the direction of arrow a along the inner surface of the drum 5 due to the electromagnetic force produced by the travelling field generator. It then falls by its weight thereby providing a complete stirring of the mixture within the drum so as to separate the non-magnetic metal particles from the mixture.

In operation, when a mixture including non-magnetic metal particles is supplied through the chute 1 into the rotary drum 5, the mixture other than the non-magnetic metal particles is lifted along the inner surface of the drum 5 while the frictional force between the mixture and the drum inner surface overcomes the weight thereof and then tumbles down onto the bottom of the rotary drum 5 and again is lifted up along the drum inner surface due to the frictional force. This is repeated so that the mixture other than the non-magnetic metal particles reaches the downstream end of the rotary drum 5. Conversely, the non-magnetic metal particles are subject to the electromagnetic force produced by the travelling magnetic field generator 10 to move in the direction opposite to the direction of rotation of the cylindrical drum 5 since the electromagnetic force overcomes the frictional force between the non-magnetic metal particles and the drum inner surface.

With the travelling magnetic field generator 10 disposed to cover the lower part of the drum 5 as shown in FIG. 7 any of the non-magnetic metal particles sent beyond the range in which the travelling electromagnetic field exists are returned to the range of the electromagnetic field due to the weight thereof, and the non-magnetic metal particles are again subject to the action of the electromagnetic force. This is repeated until the non-magnetic metal particles even those of larger or irregular size reach the downstream horn-like end of the rotary drum 5. Accordingly, because the traveling magnetic field is directed as indicated by the arrow a and the rotary drum 5 is rotated in the direction as indicated by the arrow e in FIG. 7, the non-magnetic metal particles are separated to the right as indicated by the black particles and the remainder of the mixture is sepatated to the left as indicated by white particles at the downstream end of the drum 5.

The relatively small size non-magnetic metal particles moving in the direction of rotation of the drum 5 together with the mixture having large size particles are subject to the electromagnetic force to move in the direction of the travelling magnetic field when the mixture tumbles down due to the weight thereof. On the other hand, the relatively small sized remainder of the mixture moving together with large sized non-magnetic metal particles is separated from the non-magnetic metal particles when the non-magnetic particles are returned to the range in which the travelling field exists, to move in the direction of rotation of the drum 5 by the frictional force relative to the drum inner surface and the weight thereof. Accordingly, the selection as shown in FIG. 7 is effectuated irrespective of the size of the non-magnetic metal particles.

Further since there is no obstacle within the space of the drum 5, these materials are excellently dispersed therein after tumbling down onto the bottom, so that relatively small sized non-magnetic metal particles can be exposed without being held between the larger particles of the mixture, and separation of relatively small sized materials can be provided.

These materials thus separated are transferred to the hone-shaped end of the drum 5 and separately fall down. The separation plate 11 provided with cover 15 is in contact with the inner surface of the drum, and is positioned at the boundary between the non-magnetic metal particles and the remainder of the mixture. The separation plate 11 is slidable on the inner peripheral surface of the drum 5 so that the plate can move to the upper place of the magnetic field generator 10, to thereby further ensure separation of the non-magnetic metal from the remainder.

According to the embodiment disclosed above, rollers are used to rotate the drum 5. Alternatively, power transmission belt(s) can be used to rotate the drum, or a simple gear mechanism may be employed.

What is claimed is:

1. Apparatus for selection of non-magnetic metals comprising a hollow drum inclined at an angle and having an elevated upstream end and a downstream end respectively, means contacting the outside of said drum for rotating said drum in a first direction, a shifting electromagnetic field generator disposed to cover the lower part of the periphery of the drum for generating a shifting electromagnetic field in a second direction opposite to said first direction of rotation of said drum, means for supplying a mixture including non-magnetic metal particles to the elevated upstream end of said drum, said drum having an unrestricted internal passage circumferentially and extending throughout its entire length to permit separation of particles along the lower part of the inner periphery of the drum adjacent to said electromagnetic field generator with non-magnetic particles on one side and the remainder of the mixture on the other side, and a movable separation plate mounted at the downstream end of said drum in contact with the inner surface of the drum, said movable separation plate slidable on the inner peripheral surface of the drum for positioning at a boundary between non-magnetic metal particles and the remainder of the mixture to separate non-magnetic metal particles to one side of said plate and the remainder of said mixture separated to the other side of said plate.

2. Apparatus as set forth in claim 1 wherein the means contacting the outside of the drum for rotating it comprises a pair rollers and means for driving at least one of said rollers.

3. Apparatus as set forth in claim 2 wherein said rollers are coated with an elastic material to transmit rotational movement by frictional forces.

4. Apparatus as set forth in claim 2 wherein said rollers are disposed at opposite ends of said drum.

5. Apparatus as set forth in claims 2, 3 or 4 wherein said rollers support said drum.

6. The apparatus of claim 1 wherein said drum is formed from an electrically insulative material.

7. Apparatus as set forth in claims 1 or 2 wherein said drum is inclined at an angle such that said mixture including non-magnetic particles does not pass by its weight through said rotary drum in a short time, but travels therethrough with the mixture being repeatedly brought upwardly in said first direction along the inner surface of said drum due to the frictional force between said mixture and said drum inner surface or upwardly in said second direction along said drum inner surface due to said shifting electromagnetic field and then tumbling down onto the bottom of said drum, thereby providing a complete stirring of said mixture within said drum to promote the separation of said non-magnetic metal particles from the remainder of said mixture.

* * * * *